US006886217B2

(12) United States Patent
Foster

(10) Patent No.: US 6,886,217 B2
(45) Date of Patent: May 3, 2005

(54) DOOR CLOSER

(75) Inventor: Keith Foster, London (GB)

(73) Assignee: Samuel Heath & Sons PLC, Birmingham (GB)

( * ) Notice: Subject to any disclaimer, the term of this patent is extended or adjusted under 35 U.S.C. 154(b) by 0 days.

(21) Appl. No.: 10/470,865

(22) PCT Filed: Jan. 18, 2002

(86) PCT No.: PCT/GB02/00213

§ 371 (c)(1),
(2), (4) Date: Jan. 14, 2004

(87) PCT Pub. No.: WO02/063125

PCT Pub. Date: Aug. 15, 2002

(65) Prior Publication Data

US 2004/0111831 A1 Jun. 17, 2004

(30) Foreign Application Priority Data

Feb. 2, 2001 (GB) ..... 0102610

(51) Int. Cl.[7] ..... E05F 3/00

(52) U.S. Cl. ..... 16/69; 16/54; 16/56; 16/61; 16/59

(58) Field of Search ..... 16/69, 54, 56, 16/61, 59, 68, 72

(56) References Cited

U.S. PATENT DOCUMENTS

| | | | | | |
|---|---|---|---|---|---|
| 1,334,982 | A | * | 3/1920 | Arnold | 16/70 |
| 3,887,961 | A | * | 6/1975 | Saajos | 16/56 |
| 4,317,254 | A | * | 3/1982 | Chaddock | 16/61 |
| 5,016,317 | A | * | 5/1991 | Hung | 16/54 |
| 5,706,551 | A | * | 1/1998 | Jeynes et al. | 16/59 |
| 6,625,847 | B1 | * | 9/2003 | Jones | 16/51 |

FOREIGN PATENT DOCUMENTS

WO 0052291 9/2000

* cited by examiner

*Primary Examiner*—Suzanne Dino Barrett
*Assistant Examiner*—Mark Williams
(74) *Attorney, Agent, or Firm*—MacMillan, Sobanski & Todd, LLC

(57) ABSTRACT

A door closer having a pair of main driving springs, a fluid-filled damper arrangement and a pair of thrust springs is provided, the thrust springs coming into effect during the latter part of a door closing operation, so as to provide an augmented closing force at that point. The position at which the augmented closing force is applied is variable, with a cam mechanism being used to control application of the increased closing force.

19 Claims, 7 Drawing Sheets

III
IV
II
10
11
12
13
14
15
16
17
18
19
20
21
22
23
24
25
26
27
28
29
30
31
32
33
34
35
36
37
38
40
41
45
50
52
85
86
87
88
89

DOOR CLOSER

CROSS REFERENCE TO RELATED APPLICATION(S)

This application is a national stage application of PCT Application No. PCT/GB02/00213 which was filed on Jan. 18, 2002, and published on Aug. 15, 2002 in English as International Publication No. WO 02/063125 and claims priority to British Patent Application No. 0102610.3, filed Feb. 2, 2001. This application claims Priority from the International Application pursuant to 35 U.S.C. §365.

DESCRIPTION OF AND BACKGROUND TO THE INVENTION

This invention concerns door closers of the kind comprising an actuator assembly intended for concealed fitting within the thickness of a door, and an anchor member for fixing to a door frame, and in which an operating member is coupled to said anchor member and is movable within the actuator assembly under the action of driving means, usually comprising one or more mechanical springs, and under the control of a fluid-filled damper (usually uni-directionally operative) which serves to regulate the rate of movement of the door in the direction of closure without significantly restricting the rate of movement of the door in the direction of opening.

It is desirable for the action of any damper in such a door closer to be adjustable so as to enable the rate of closure to be set to fall within a chosen range despite variations in the weight and other parameters of different doors with which the closer may be used, and for the closer to provide an augmented closing force as the door reaches its closed position in order to overcome resistance from any latch fitted to the door. It is also desirable, and often necessary, from a product performance viewpoint, that the arrangement employed to provide such an augmented closing force is able to operate smoothly over a very large number of repeated uses.

SUMMARY OF THE PRIOR ART

EP 0 016 445 A discloses a door closer in which adjustment of the final part of the closure movement of the door is achieved by means of an adjustment member associated with the anchor member which is attached to the door frame, the adjustment member being disposed behind a mounting plate of the anchor member at a variable spacing so as effectively to adjust the length of the coupling between the anchor member and the operating member in the actuator assembly. This arrangement does not make any provision for adjustment of the overall rate of closure, but only in the final closure position of the door relative to a final part of the travel of the piston in the door-closing direction, in which final part of the travel the action of the damper is rendered ineffective so as to provide for a locally increased rate of closure movement to overcome any resistance which may be offered by a door latch for example.

Although the rate of movement of the door as it approaches its position of closure is increased, there is no provision for adjusting the driving force applied to the door over the final part of closure movement, as relieving the effect of the damper does not increase the force applied by the driving springs, but only allows the door to accelerate in response to the driving force and the closing action then relies on the momentum of the moving door to overcome latch resistance. However, the acceleration achieved depends on many variable factors, including the weight of the door, wind loading on the door, and frictional resistance in the hinges and in the latch itself, and accordingly such a design does not entirely address the problem of overcoming resistance associated with a door latch.

DE 1 708 349 A discloses a door closer having a main spring which acts over the full range of movement of a rod which is coupled by a link to an anchor member, and a supplementary spring arranged end to end with the main spring which is effective to increase the driving force applied to the rod over the final part of the closure stroke, but without provision for varying the point at which the supplementary spring becomes effective.

WO 00/52291 discloses a door closer having a pair of thrust springs which are operative to increase the closing force exerted on the door as the door reaches its closed position, the point at which the thrust springs come into effect being adjustable, so that variations in the width of the gap between an inner edge of the door and the door frame may be compensated for. The arrangement which is employed to retrain/release the thrust springs utilises a plurality of balls moveable radially within a cage to engage in grooves in moveable components.

Accordingly, it is an object of the present invention to provide an improved door closer which enables an augmented closure force to come into play as the door approaches its position of closure, and which provides for adjustment of the operation to suit a wide range of requirements. It is also an object of the present invention to provide an improved control means which controls the application of the augmented closure force.

SUMMARY OF THE INVENTION

According to a first aspect of the invention we provide a door closer comprising:

an anchor member for mounting on a door frame, an actuator assembly for mounting within the thickness of a door which is hinged for movement between open and closed positions relative to said door frame, an operating member coupled by an articulated link to said anchor member and mounted in said actuator assembly for a range of movement between a retracted position in which said anchor member is held adjacent to said actuator assembly and an extended position in which said anchor member is held in spaced rotation to said actuator assembly, resilient driving means arranged to exert a driving force on said operating member in a manner such as to drive said operating member towards said retracted position and thereby draw said anchor member and said actuator assembly together such that, when installed, the door closer acts to draw the door into its closed position-relative to the frame, a damper connected to said operating member so as to control the rate of movement of the operating member in at least a direction towards said retracted position, said damper comprising a cylinder containing hydraulic fluid, a piston rod carrying a piston which divides the cylinder into two chambers, and flow-restricting means to limit the rate of flow of hydraulic fluid from one of said chambers to the other at least in one direction of fluid flow in response to movement of said operating member towards said retracted position, resilient thrust means arranged to exert an increased driving force on said operating member, control means whereby said thrust means is operative to apply said increased driving force to said operating member over a defined part of said range of movement as said operating member approaches said retracted position, corresponding to movement of the door over the final part of its movement into its closed position, and an adjustment member operatively connected with said control means to vary the point in the range of movement of said operating member at which said resilient thrust means becomes operative to apply said increased driving force, characterised in that the control means comprises a cam mechanism having a cam surface and a cam follower operatively associated with said thrust means, in that movement of said cam follower along said cam surface causes deformation of said thrust means.

The cam surface may comprise part of a slot provided in a control sleeve, the cam follower being moveable along a slot provided in a control member, the control member being slidably received within said control sleeve, movement of said operating member between said retracted and extended positions effecting movement of said control member within said control sleeve.

The slot in the control sleeve may comprise a first part extending generally parallel to a longitudinal axis thereof and a second part extending obliquely away from said first part.

The second part preferably extends away from said first part at an angle of about 45°.

The control sleeve and control member may each be generally cylindrical.

Conveniently, two similarly configured slots are provided in opposing surfaces of the control sleeve.

Desirably, the cam follower is adapted to engage both said parts.

The second parts of the slots preferably lie on different sides of a plane containing the first parts, such that movement of the cam follower therealong causes the cam follower to undergo angular movement about a longitudinal axis of the control member.

The cam follower is preferably associated with said rust means such that said angular movement of said cam follower deforms said thrust means in both a compressive and a torsional manner.

The cam follower may comprise a roller rotatably mounted about a retaining pin.

An end of the trust means is preferably attached to or integral with a retaining member slidably received within said control member.

The retaining member may be received within the control member in such a manner that it is capable of undergoing angular movement about said longitudinal axis of the control member, angular movement of said cam follower effecting angular movement of said retaining member.

The control sleeve and control member are preferably restrained against angular movement relative to each other about their respective longitudinal axes. Thus, the control member may be attached to or integral with a cross-head operatively associated with said operating member in such a manner that angular movement relative thereto is resisted or prevented.

The slot in the control member may be approximately the same length as the second part of the slot in the control sleeve.

The slot in the control member preferably extends away from the longitudinal axis thereof at an angle approximately equal to the angle at which said second part extends away from said first part.

Conveniently, two similarly configured slots are provided in opposing surfaces of the control member.

The thrust means may comprise a compression spring, ends of the compression spring conveniently being attached to or integral with said retaining member and cross-head respectively.

The door closer may comprise an adjustable throttle which comprises two elements in combination, the flow restriction imposed on the hydraulic fluid by said throttle being variable by relative positional adjustment of said two throttle elements, and an adjustment member to enable one of said throttle elements to be positionally adjusted relative to the other so as to vary the flow restriction imposed on the hydraulic fluid by said throttle.

In a preferred arrangement the cylinder of the damper is moveable relative to the actuator assembly and the piston is static, and the flow restriction means is incorporated into said piston and piston rod, and the adjustment member has an operating element which is accessible from one end of said piston rod.

The adjustment member may comprise a shaft located within an axial bore formed in said piston rod, with an external threaded formation engaging an internal threaded formation in the bore of the piston rod whereby rotation of the shaft varies its axial position within said bore. The shaft may be provided at one end with a needle formation which comprises one of said throttle elements to co-operate with an orifice defined by the other of said elements, and at its other end with a head formation whereby the shaft may be rotated.

The thrust means may comprise one or more spring elements having a higher rate than the resilient driving means. Preferably both the driving means and the thrust means comprise one or more coiled compression springs, but other arrangements are possible. For example the thrust means may comprise one or more stacks of Belville washers, and the driving means could comprise gas-springs.

In a particularly convenient arrangement, said thrust means and said driving means each comprise two elements disposed symmetrically relative to a single damper means, but other arrangements are possible.

In accordance with a further aspect of the present invention, we provide control means for controlling thrust means of the type which is operative to apply an increased driving force to an operating member of a door closer, the control means comprising a cam mechanism having a cam surface and a cam follower operatively associated with said thrust means, movement of said cam follower along said cam surface causing deformation of said just means.

BRIEF DESCRIPTION OF THE DRAWINGS

These and other features of the invention will now be described by way of example with reference to the accompanying drawings wherein.

DETAILED DESCRIPTION OF THE DRAWINGS AND BEST MODE OF THE INVENTION

Figures 1A, 1B:
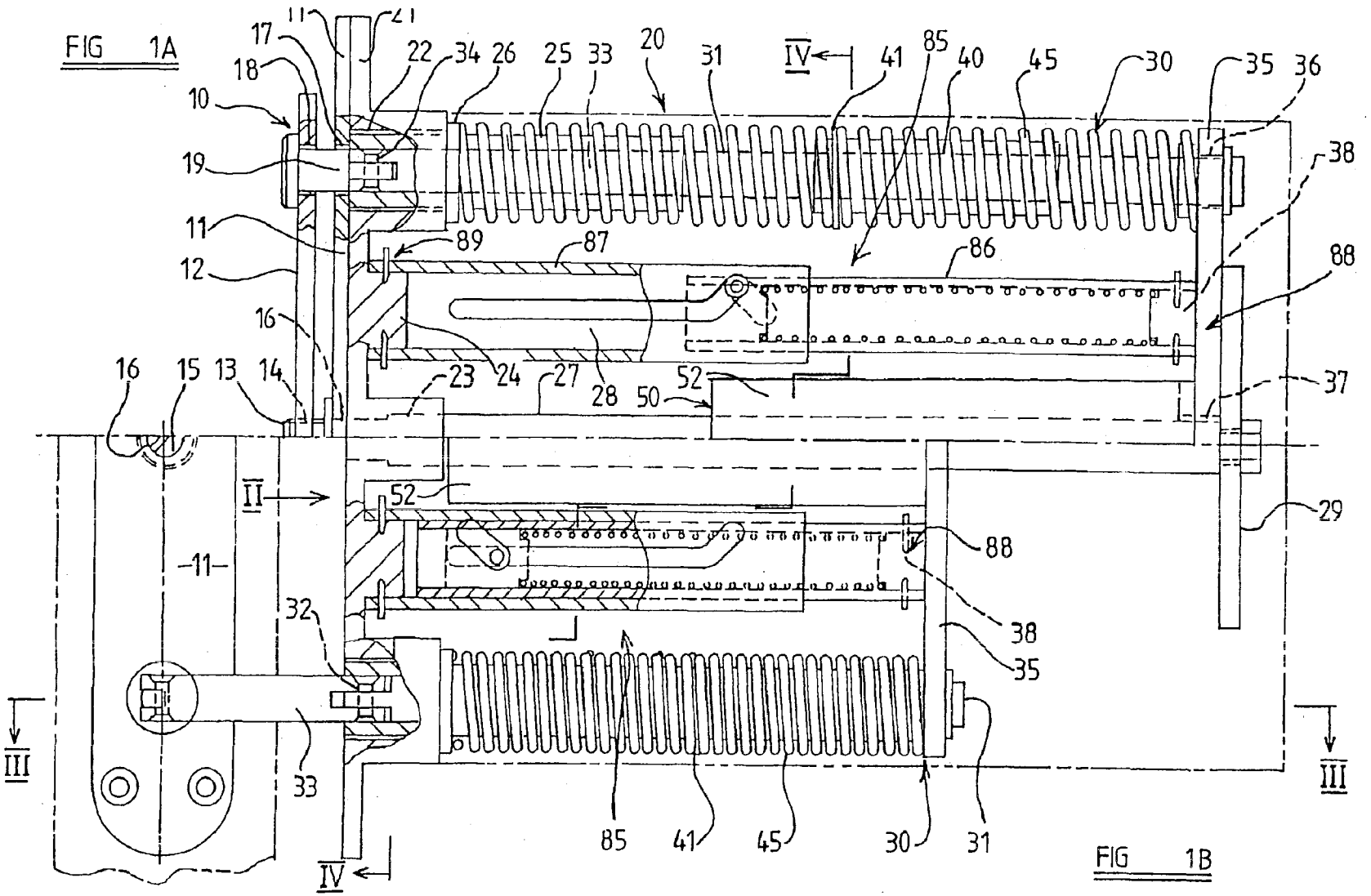
FIGS. 1A and 1B are partially sectioned side views of one embodiment of a door closer to which the invention is applied, comprising an anchor assembly and an actuator assembly, and shown with these assemblies respectively in the "door closed" condition and in the "door open" condition.
Figure 2:
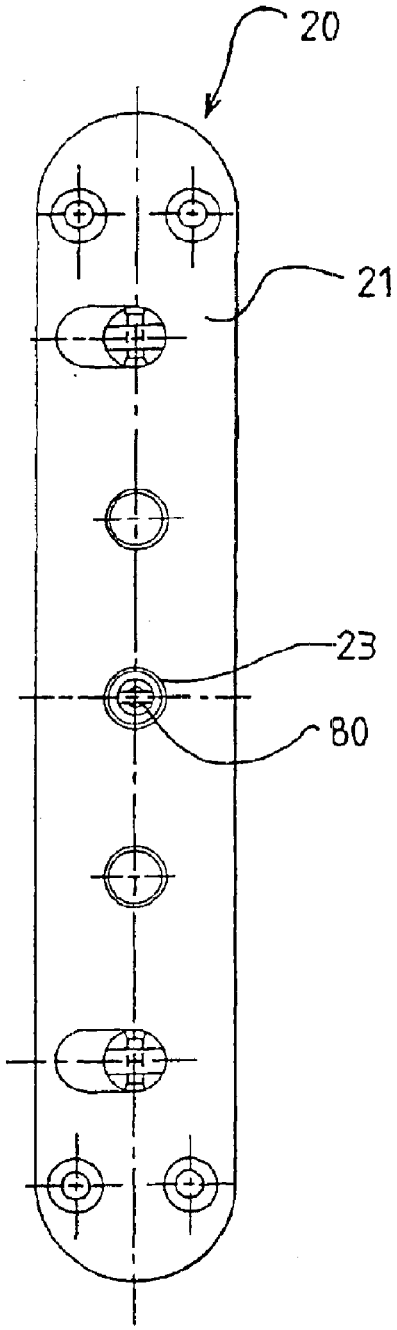
FIG. 2 is a front end view of the actuator assembly in the direction of arrow II of FIG. 1B.
Figure 4:
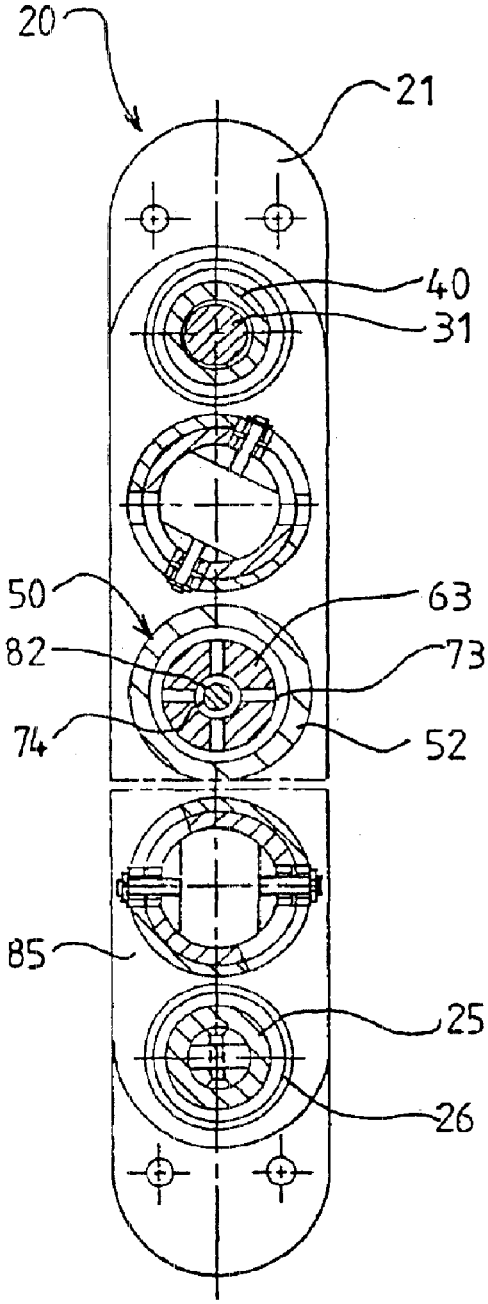
FIG. 4 is a composite section substantially on the line IV—IV of FIGS. 1A and 1B.

The door closer as illustrated in FIGS. 1 to 9 comprises an anchor assembly 10 which is adapted for mounting in a door frame at a vertical edge thereof facing the hinged edge of a door hingedly carried by the frame, and an actuator assembly 20 which is adapted for mounting within the thickness of the door.

The anchor assembly 10 comprises a mounting plate 11 and an adjustment plate 12 which is spaced from the mounting plate on the side thereof remote from the door by an adjustable distance. An adjusting screw 13 is engaged in a threaded hole 14 formed in the adjustment plate 12 and a slotted head portion 15 of the screw bears against the mounting plate 12 and is accessible through a central hole 16 formed in the mounting plate 11. It will be understood that by rotation of the screw 13 the spacing of the adjustment plate 12 and mounting plate 11 can be varied for the purpose hereinafter described.

The mounting plate 11 is also formed with a pair of apertures 17 near the ends thereof and the adjustment plate 12 is formed with a pair of apertures 18 aligned with the apertures 17 whereby the adjustment plate 12 is coupled to an operating member 30 of the actuator assembly 20 as hereinafter described.

The actuator assembly 20 is so dimensioned as to be suitable for fitting within the thickness of the door and for this purpose is provided with a mounting member 21 having bosses near the outer ends thereof formed with apertures 22 which align with the apertures 17 of the anchor assembly mounting plate 11, a central boss formed with a bore 23, and intermediate bosses 24.

The apertures 22 locate therein fixed sleeves 25 which are provided with an external flange 26 abutting against the end face of the boss around aperture 22. The central bore 23 is partially threaded to receive a threaded end portion of a rod 27, and the intermediate bosses 24 each locate one end of a control sleeve 87 (see FIGS. 6 and 7) by means of screws or pins, as shown. The sleeves 25 and rod 27 extend parallel to one another, there being provided a transverse stop plate 29 having an intermediate boss 38 which is secured to the free end of the rod 27 by means of screws or the like, and to one end of a thrust means control member 86, by screws or pins as shown in more detail in FIGS. 6 and 7.

The actuator assembly 20 further includes an operating member 30, as above-mentioned, which is carried by the mounting member 21 and guided for longitudinal movement by the sleeves 25 and rod 27. The operating member 30 includes a pair of parallel shafts 31 which are located in the sleeves 25, each having at one end a pivotal connection 32 to a respective rigid link 33 which is disposed within the associated sleeve 25 when the closer is in the "door closed" condition as shown in FIG. 1A. The links 33 have a pivotal connection 34 with respective headed studs 19 which extend through the apertures 17 in the mounting plate 11 and through apertures 18 in the adjustment plate 12 of the anchor assembly 10. The links thus form an articulated connection between the shafts 31 and the anchor assembly 10.

The operating member 30 further includes, at the other end of the shafts 31, a cross-head 35 by which the shafts 31 are interconnected The cross-head 35 is formed with outermost bosses with apertures 36 through which the shafts 31 extend and the cross-head is secured to the shafts 31 by means of pins (not shown). As seen most clearly in FIG. 5, the cross-head 35 is also formed with a central boss and a central aperture 37 in which the end of the rod 27 is located with a sealing ring, and a pair of intermediate bosses 38 to which thrust means control members 86 are attached by means of pins or screws.

The operating member 30 is biased inwardly towards the retracted or "door closed" position shown in FIG. 1A under the force of driving springs 45, which, in the illustrated embodiment, compromise coil springs extending between the cross-head 35 and the flanges 26 on the fixed sleeves 25. In addition, floating sleeves 40 are located on each of the shafts 31 and carry a respective clip 41 which engages between turns of the respective spring 45. Alternatively, separate springs may be provided on opposite sides of the clip 41.

As will be evident, the compression springs 45 act on the cross-head 35 to drive the latter inwardly of the actuator assembly 20 (i.e. to the right of FIGS. 1A and 1B) to the retracted position and to draw the shafts 31 and the associated links 33 inwardly so as to bring the mounting plate 11 of the anchor assembly 10 up to the mounting member 21 of the actuator assembly, in the manner illustrated in FIG. 1A, thereby holding the door in its closed position.

Figure 3:
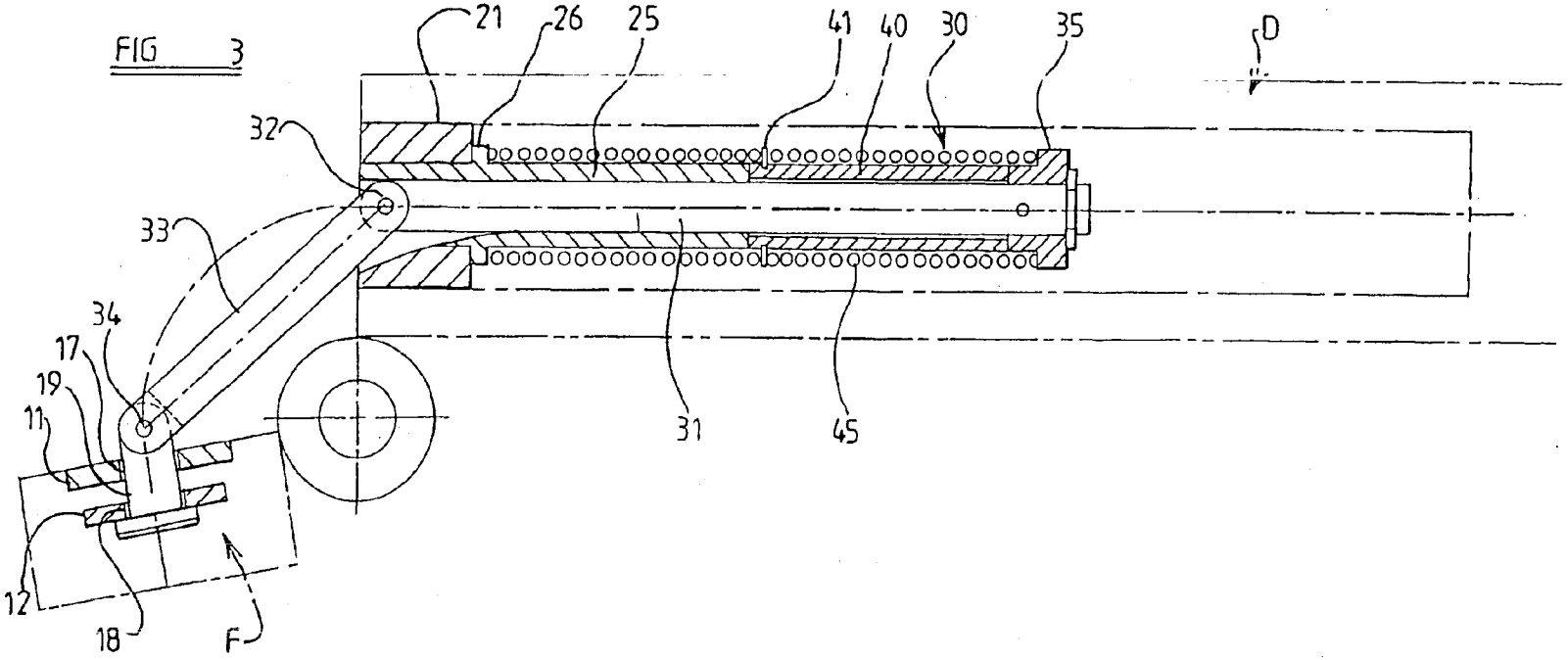
FIG. 3 is a horizontal section on the line III—III of FIG. 1B.

When the door is opened, as shown in FIGS. 1B and 3, the shafts 31 and cross-head 35 are drawn outwardly (i.e. to the left of FIGS. 1A and 1B), thereby causing the springs 45 to be compressed, abutment of the floating sleeves 40 against the fixed sleeves 25 limiting the outward travel of the cross-head 35 at an extended or "door open" position When the door is released, the coil springs 45 act to return the cross-head 35 and the shafts 31 to their starting positions, thereby bringing the door back to its closed position relative to the frame.

The actuator assembly 20 further includes a damper assembly 50 to regulate the rate of closure of the door under the action of the springs 45.

Figure 5:
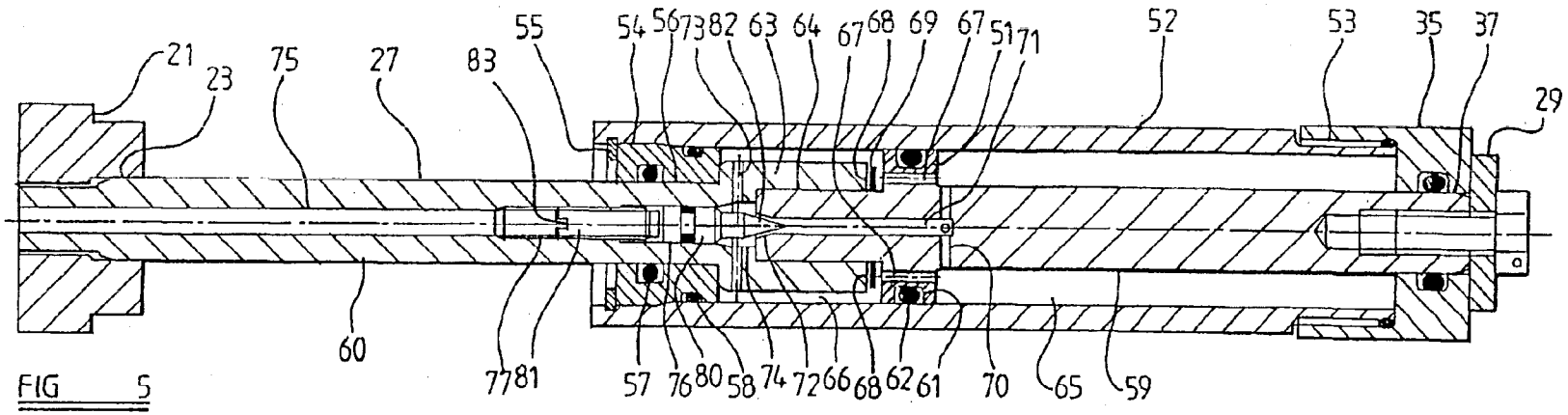
FIG. 5 is a longitudinal section through an adjustable damper assembly incorporated in the closer.

The damper assembly 50 as shown in FIG. 5 comprises a fixed piston 51 formed on the rod 27 at an intermediate position, and a cylinder 52 carried by the cross-head 35 and containing hydraulic fluid. The cylinder 52 is located at one end, with an appropriate seal, in a recess 53 formed in a boss at the centre of the cross-head 35, and is closed at its other end by a plug 54, which is retained by means of a clip 55 in the mouth of the cylinder. The plug 54 is formed with a bore 56 through which the piston rod 27 passes. Appropriate sealing rings 57, 58 are arranged to engage sealingly with the exterior surface of the rod 27 and with the interior surface of the cylinder 52 as shown.

In the illustrated embodiment the fixed piston rod 27 is assembled from first and second rod sections 59, 60. The first rod section 59 is formed with a radial enlargement having a peripheral groove 61 for a sealing ring 62 which engages with the interior face of the cylinder 52 so that the enlargement serves as the piston 51. The second rod section 60 includes a widened end portion 63 which has an internal bore 64 to receive an end portion of the first rod section 59.

The piston 51 divides the cylinder 52 into inner and outer compartments 65, 66 and fluid passageways as hereinafter described are formed in the piston 51 and the rod 27 to enable hydraulic fluid to pass from one compartment of the cylinder to the other in a controlled manner.

Axial passageways 67 extend directly between opposite faces of the piston 51. The widened end portion 63 of the second rod section 60 has an end face 68 which is spaced axially from the piston 51, and a flexible seal 69 is disposed between the end face 68 and the piston 51. The flexible seal 69 is moveable within the gap between the end face 68 and the piston 51 in response to fluid pressure so as to close or open the axial passageways 67.

The flexible seal 69 lifts from the ends of the axial passageways 67 in response to opening movement of the door, so that fluid may flow freely from the inner compartment 65 to the outer compartment 66 and the door may be opened freely. However, in response to movement of the door towards its closed position the flexible seal 69 covers the ends of the axial passageways 67 in such a manner as to prevent liquid flowing directly from the outer compartment 66 to the inner compartment 65 through the axial passageways 67.

To enable fluid to flow from the outer compartment 66 to the inner compartment 65, radial passageways 70 are formed in the first rod section 59 adjacent to the face of the piston which is presented towards the cross-head 35 to communicate with a central bore 71 which terminates, at the end of the first rod section 59 which is presented towards the mounting member 21, in a throttling orifice 72. Further radial passageways 73 extend from the outer face of the widened end portion 63 of the outer rod portion 60 to a central chamber 74 formed at the inner end of an axial bore 75 which extends through the second rod section 60 to its outer end where it is received in the central bore 23 of the mounting member 21.

The axial bore 75 includes a widened end portion 76 adjacent to the central chamber 74, and an internally threaded portion 77 adjacent to the widened end portion 76. The widened end portion 76 receives an adjustable throttle member 80 which includes an externally threaded shank portion 81 received within the internally threaded portion 77 of the bore 75, and a needle portion 82 which co-operates with the orifice 72. The shank portion 81 of the throttle member 80 is formed with slot 83 to receive the end of a screwdriver blade which can be inserted along the bore 75, to enable the throttle member 80 to be rotated to adjust the axial position of the needle portion 82 relative to the throttle orifice 72 to provide a variable restriction.

When the passageways 67 are closed by the flexible seal 69, communication between the two compartments of the cylinder 52 is only possible through passageways 70, 71 and 73, and the throttling orifice 72. In this way, the orifice 72 serves as an adjustable throttle to regulate the flow of fluid from the outer compartment 66 to the inner compartment 65 as the cross-head 35 is driven inwardly of the actuator assembly by the compression springs 45. The rate at which the door is closed under the force of the springs 45 can thus be adjusted, and it is particularly to be noted that such regulation is effective throughout the entire range of movement of the operating member 30 from the extended position shown in FIG. 1B to the retracted position shown in FIG. 1A. However, on the reverse stroke, when the door is being opened, the flexible seal 69 is able to lift from the ends of the axial passageways 67 and allow relatively unrestricted flow of fluid between the two compartments.

The actuator assembly 20 further includes a pair of thrust assemblies 85 mounted between the bosses 24 and 38, the thrust assemblies being disposed between the respective driving springs 45 and the damper assembly 50.

Figure 6:
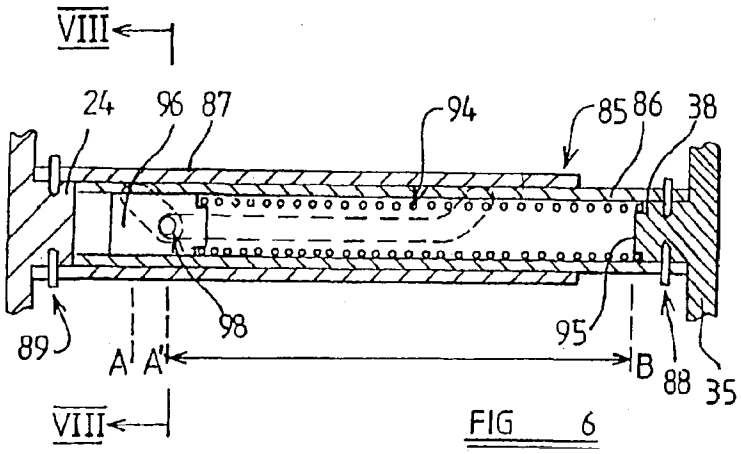
FIG. 6 is a more detailed, sectional view of the thrust and control means shown in a first, compressed condition, as per FIG. 1B.
Figure 7:
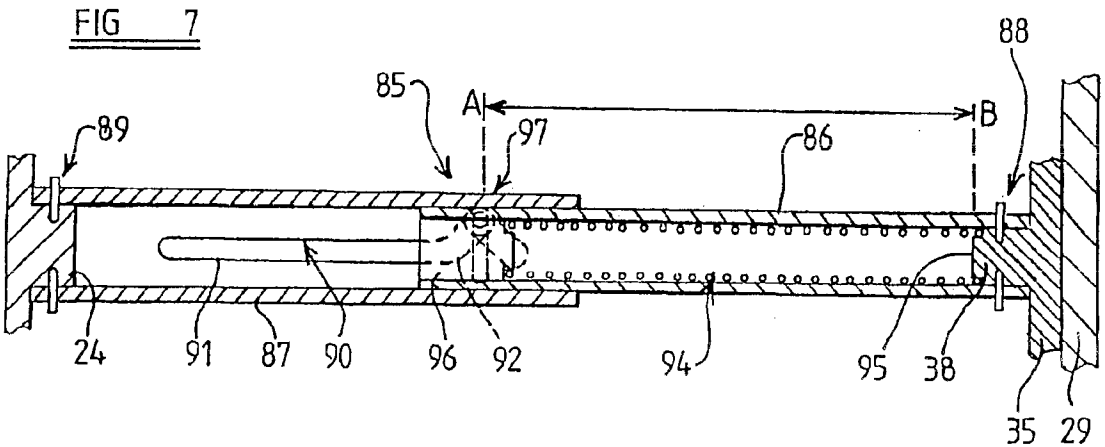
FIG. 7 is a more detailed sectional view of the thrust and control means shown in a second, uncompressed condition, as per FIG. 1A.

As shown in FIGS. 6 and 7, each thrust assembly 85 includes a hollow cylindrical control member 86 which is slidably received within a hollow cylindrical control sleeve 87, the sleeve 87 having a slightly greater diameter than that of the control member 86 such that clearance between the outer surface of the control member 86 and the inner surface of the control sleeve 87 is kept to a minimum. This ensures that the control member and sleeve remain generally concentric, allowing smooth sliding movement to occur between them. As shown in FIGS. 1A and 1B, an innermost end portion 88 of the control member 86 is pinned to the outside of a boss 38, thus securing the control member thereto, and ensuring that no angular or rotational movement of the control member 86 is permitted relative to the boss 38. An outermost end portion 89 of the control sleeve 87 is pinned to the outer surface of boss 24, the sleeve 87 thus similarly being prevented from movement relative to the boss 24.

Figure 9A:
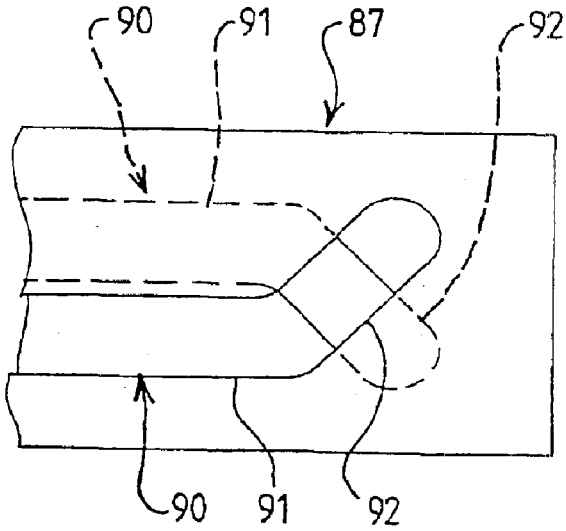
Figure 9B:
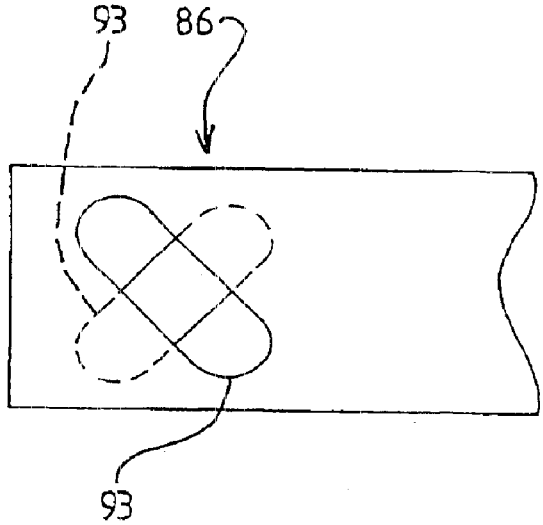

As shown in FIGS. 7 and 9A the control sleeve 87 is provided with a pair of similarly configured slots 90, one on each "side" of the sleeve. For clarity, only one "side" is shown in FIG. 7. Each slot 90 has a first, generally straight part 91 and a second part 92 extending obliquely away from the first part 91 at an angle of about 45°. The first part 91 is substantially parallel with the longitudinal axis of the control sleeve 87, with the second part 92 extending away from the first part 91 in generally opposite directions, for the purpose hereinafter described. Thus, in FIG. 7, the part 92 of the "near-side" slot 90 extends upwardly from the longitudinal axis. The corresponding part on the "far-side" extends downwardly from the axis. The control member 86 is provided with a pair of slots 93, the slots 93 extending at an angle of about 45° to the longitudinal axis of the control member 86, as shown in FIG. 9B.

Figure 8:
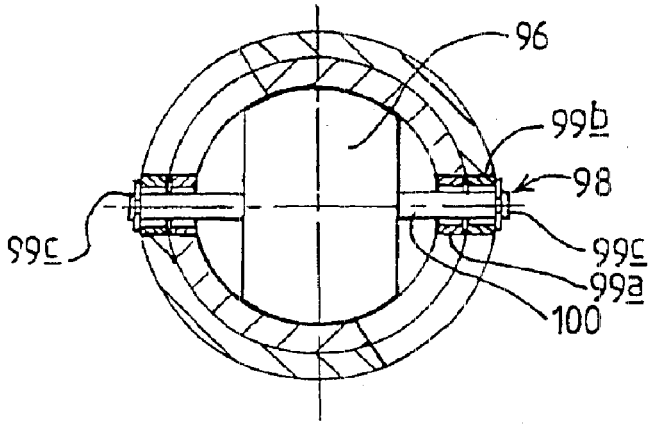
FIG. 8 is a transverse section on an enlarged scale on the line VIII—VIII of FIG. 6, FIGS. 9A and 9B show details of the control means.

Thrust springs—in the form of compression springs 94 having a rate greater than that of the main coil springs 45—are disposed within the control members 86, innermost ends of which being secured to a stop 95 which itself is pinned to the inside of the control member 86. The outermost ends of the thrust springs 94 are attached to a retaining member 96 which is located towards the outermost end 97, and which has a circular or part circular cross-section, as shown especially in FIG. 8. The retaining member 96 is provided with a through-bore (not shown) within which is located a cam follower 98 comprising inner and outer cam rollers 99*a* and 99*b* and a retaining pin 100, about which the cam rollers may each rotate. The cam rollers 99*a* and 99*b* are maintained in position relative to the retaining pin 100 by a pair of enlarged portions or fasteners 99*c*. As the cam follower arrangement 98 is located within the through-bore provided in the retaining member 96, it will be appreciated that any movement of the retaining member will effect movement of the cam follower, and vice versa As shown in FIG. 8, the radius of the retaining pin 100 is approximately half that of the cam rollers 99*a* and 99*b*, as such a configuration has been found to minimise the unwanted effects of friction. It will however be appreciated that other relative radii could conceivably be adopted, and that just one roller—on the inner or outer race—could be used. Although it may give rise to increased frictional resistance, it is envisaged that an arrangement having only a pin could be used, the outer surface of the pin bearing directly on the sides of the slots 90 and 93.

Referring to FIG. 7, which shows the thrust assembly in a "door closed" position, it will be seen that the compression spring 94 is not compressed to any material extent, and no effective force is thus exerted by the spring 94 on the retaining member 96. However, as the door moves from a closed to an open position, as shown in FIG. 6, the control member 86 is pushed further inside the control sleeve 87, walls of the second part of the slot in the control sleeve 90 thus acting as a cam surface for the cam follower 98, causing the cam follower 98, and hence the retaining member 96 and the compression spring 94 attached thereto, to undergo axial and angular movement relative to the longitudinal axis of the control member 86.

It will be appreciated that the outermost ends of the thrust springs could be attached to the retaining members 96 in such a manner as to permit the springs; to rotate relative thereto. Thus, during movement of the door from a closed to an open position, it is possible that the thrust sp-rings could undergo only axial movement, resulting in no torsional deformation.

Movement of the cam follower 98 relative to the control member 86 is permitted by the pair of slots 93 in the control member 86, with this movement continuing until the cam follower 98 reaches the junction between the first and second parts 91 and 92 of the control sleeve slots, at which point the first part of the control sleeve slot 90 restrains the cam follower 98 against further angular movement.

It will be appreciated that in view of the fact that the cam follower 98—and hence the retaining member 96—has moved axially in relation to the control member 86, by virtue of the angled slot 93 disposed therein, that in addition to a torsional force being applied to the thrust spring 94, a compressive force is also applied.

Thus, once the cam follower 98 reaches the straight first part 91 of the control sleeve slot 90, the thrust springs 94 are "primed" in a stressed "ready" condition.

During the remainder of the door opening process, the cam follower 98 travels along the remainder of the slot 90, until the cam roller 99 abuts the distal end of the slot 90, corresponding to maximum opening of the door. It will be appreciated that while the cam follower 98 travels along the first part of the slot 90, the energy stored within the thrust springs 94 remains substantially constant, as the thrust springs 94 are not permitted to expand or move in any way, bearing in mind that both ends thereof are held in a fixed position relative to each other by the retaining member 96 and the boss 38 which moves with the cross-head 35.

Upon subsequent closure of the door, however, the reverse happens. Specifically, as the door approaches the point of final closure, the cam follower 98—now moving to the right of FIGS. 6 and 7—leaves the straight first part 90 of the control sleeve 87, and re-enters the angled second part 92 thereof. At this point, the wall of the second part 92 provides the cam follower 98 with a surface against which a force may be exerted, thus allowing the energy stored within the thrust spring 94 to be released, the spring 94 thus extending—and undergoing some angular movement—back towards its "free" state, as shown in FIG. 7.

From this, it will be appreciated that during the initial stage of the door opening process, and the final stage of the door closing process, an additional force is exerted by the thrust spring 94 against the cross-head 35, thus urging the cross-head 35—and hence the operating member 30—towards a "door closed" position.

On the other hand, during the "main part" of the door opening and closing operations (i.e. where the cam follower 98 travels along the straight part 91 of the control sleeve slot 90), the thrust springs exert no force on the cross-head 35 which is effective to resist—or assist—movement of the door.

Thus, the effect of the thrust assembly is to provide an additional closing force during the final stage of a door closing operation, thus overcoming any resistance to door closure which may, for example, be imposed by a latching mechanism which operates between the door and the door frame.

Although a number of materials may be suitable, it is believed that a hard stainless steel may be particularly advantageous, bearing in mind that the relative sliding movement of the control sleeve 87, control member 86, cam follower 98 and retaining member 96 could well give rise to undesirable wear problems. It is also envisaged that the mutually engaging services of the various components could conceivably be coated with a material having an extremely low co-efficient of friction (such as PTFE) to reduce such wear problems as far as possible.

The adjustment plate 12 enables the point at which the thrust springs 94 come into operation to be varied. Adjustment of the adjustment plate 12 relative to the mounting plate 11 of the anchor assembly 10 alters the angular position of the door at which the cam follower 98 engages the second part 92 of the slot 90, by varying the spacing between the mounting plate 11 of the anchor assembly 10 and the cross-head 35 of the operating member 30. In this way the fixed position of the second parts 92 of the slots 90 corresponds to any selected position of the mounting plate 11 within a predetermined range of positions. Typically, the range of adjustment may be between 0° and about 15° of opening. Thus at one extreme, the thrust springs may be rendered ineffective if desired, whilst the range of angular movement over which they are effective, when required, can be set at up to 15° or thereabouts according to the precise geometry adopted.

Figure 10:
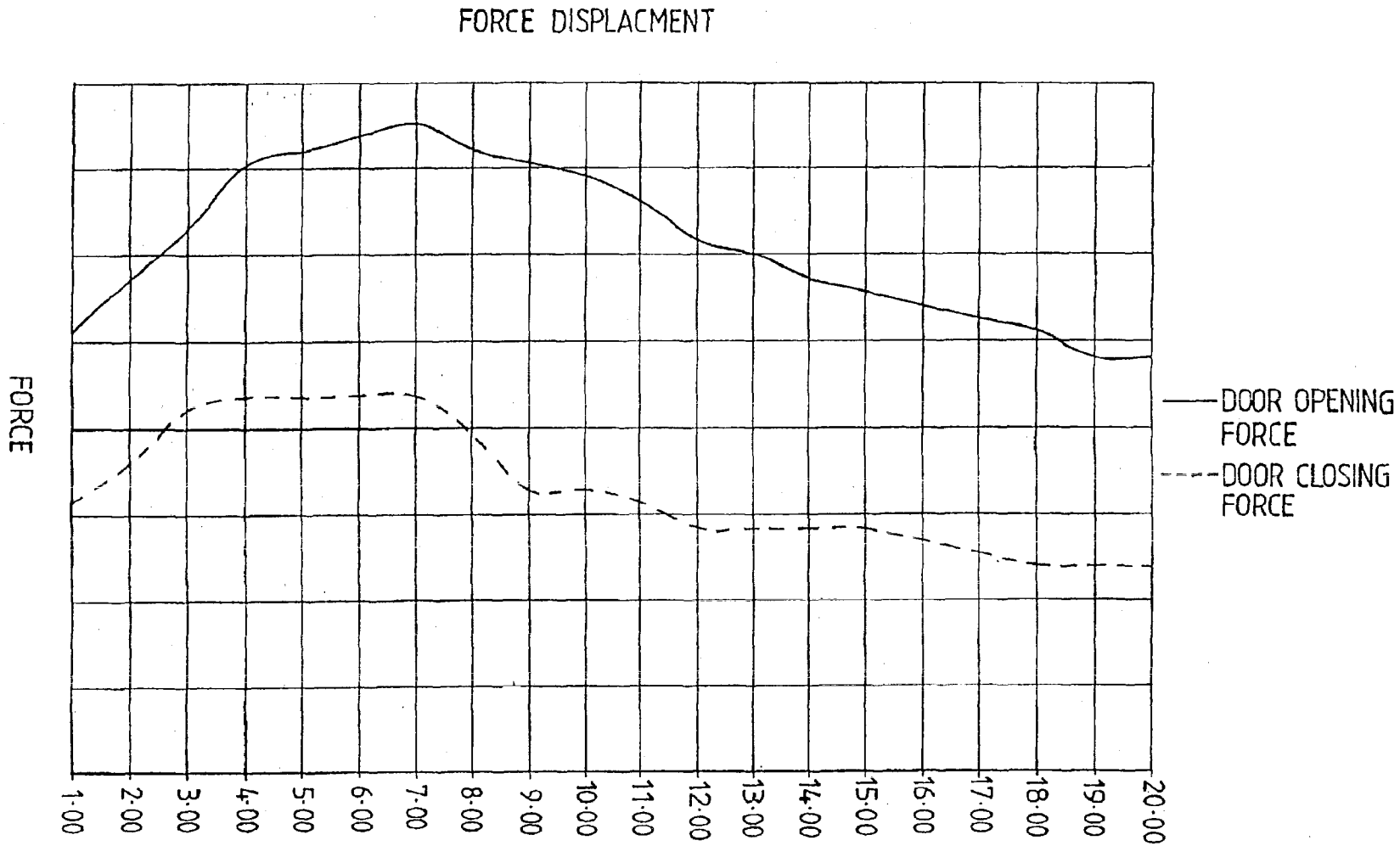
FIG. 10 is a graph relating the closure force obtained from a closer in accordance with the invention to the angle of opening.

In other words, adjustment of the adjustment plate 12—and hence alteration of the spacing between the cross-head 35 and the mounting plate 11—alters the starting position of the cam follower 98 in the slot 90. At one extreme (shown in FIG. 7) compression and torsional deformation of the thrust spring 94 occurs throughout movement of the cam follower 98 from a distal end of the second part 92 to the junction between the first and second parts 91 and 92 of the slot 90. At another extreme, where the cross-head 35 has been adjusted to such an extent that the cam follower—at a door closed position—is already located within the straight first part 91, the thrust springs 94 are maintained ineffective against sliding movement of the cross-head 35 throughout the door opening and closing operations. Thus, at all times during the closing action, the rate of movement of the door is controlled by the damper assembly 50 but, as illustrated in FIG. 10, the closing force applied by the driving springs 45 can be substantially augmented by the thrust springs 94 over a variable final part of the closure movement, thus overcoming any resistance to closure which may be imposed by a latching mechanism operating between the door and door frame, but without the potentially excessive "snap action" associated with previous door closers of the kind in which the flow restriction imposed by the damper assembly is relieved during the final part of the closure movement. However, adjustment of the damper makes it possible to provide a controlled degree of snap action, when the flow restriction is set to a minimum, or a "soft" action, when the flow restriction is set to a maximum, or anything in between.

Adjustment of the position of the adjustment plate 12 of the anchor assembly 10 varies the effective length of the connection between the cross-head 35 and the anchor assembly, and can thus also enable the action of the thrust springs 94 to cut in at the correct point despite variations in the width of the gap between the inner edge of the door and the door frame in different installations.

The door closer as above described is fully adjustable with respect to the selected range of angular movement over which the augmented closure force is applied, and with respect to the degree of damping applied, whilst being particularly compact so that it can be installed in a door without compromising the fire resistance of the door.

The effect of the thrust springs on the opening and closing forces generated using a door closer in accordance with the present invention is shown graphically in FIG. 10—a graph showing these forces, plotted against a range of door/frame angles. Specifically, the graph shows opening and closing forces relative to degrees of opening of a 750 mm wide door at the furthest point from its hinge pivot point. From this, it is evident that opening angles of between about 3° and about 7° produce the greatest opening and closing forces. Additionally, it can be seen that the augmentation of the closing force, as the door returns towards a closed position, is smooth, in consequence of the cammed configuration of the control means, which gradually brings the thrust springs 94 into operation. By movement of the adjustment plate 12, the point (i.e. door angle) at which the thrust springs 94 come into operation can be varied throughout a range of between 0° and about 15°, so that the force profiles shown in FIG. 10 may be "shifted" laterally, in that the force "peaks" can appear at a range of different opening and closing angles.

Figure 11:
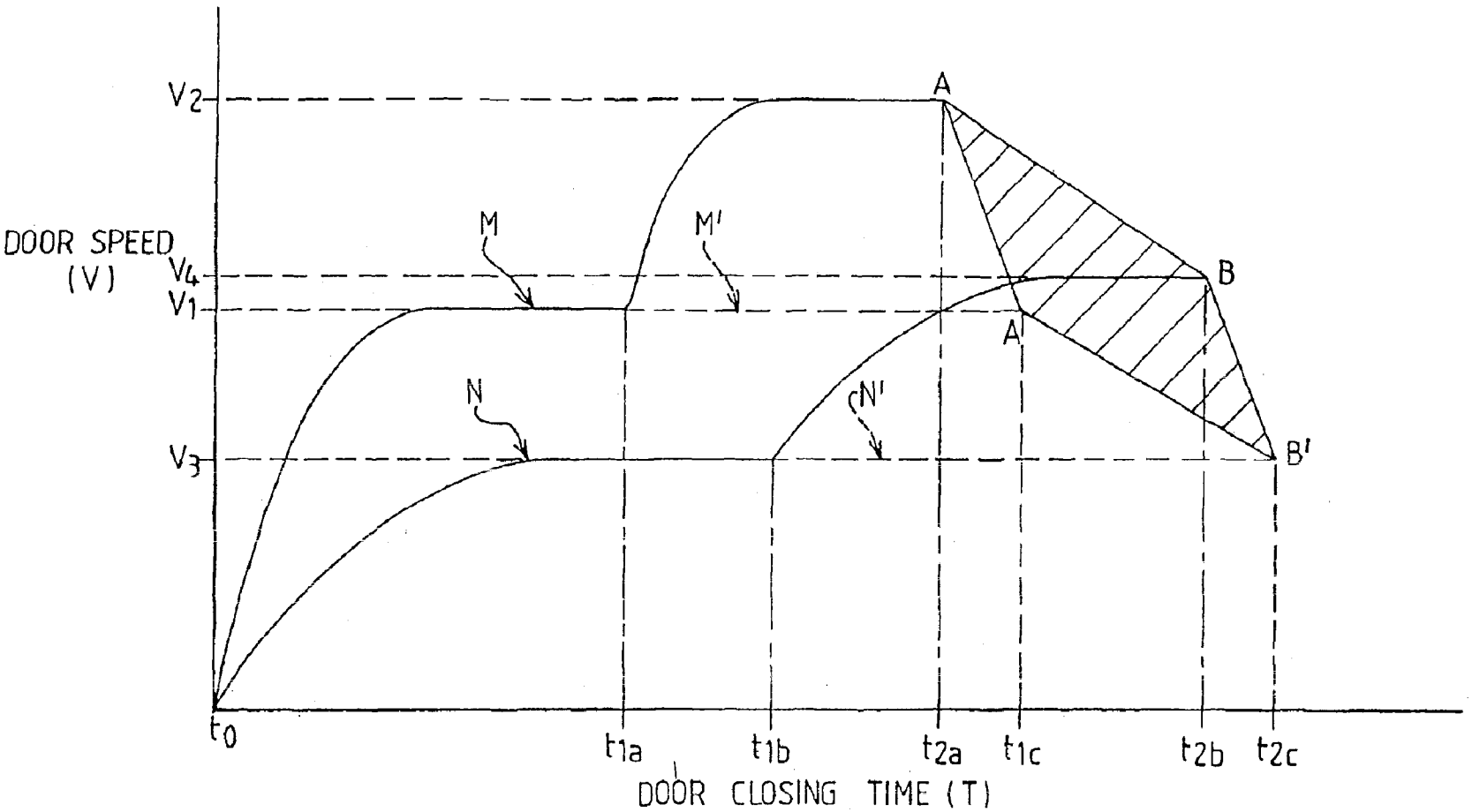
FIG. 11 is a graph relating the door closure speed to door closing time.

The effect of the damper is illustrated in FIG. 11 which shows the door closing speed (V) plotted against door closing time (T) from the position of maximum opening to closure, with minimum and maximum damping and an indication of the variable range of operation of the thrust springs.

With the damping set at minimum, and the action of the thrust springs set at maximum, the door speed follows the upper solid line curve (M), from which it can be seen that at time=$t_0$ the door accelerates from rest to a uniform velocity $V_1$ and at time=$t_{1a}$ the thrust springs become effective with the result that the door speed increases to a higher velocity $V_2$ until at point A the door reaches its position of closure at time=$t_{2a}$.

If the damping is set at the maximum value, the door speed follows the lower solid line curve (N) to a lower velocity $V_3$ and the thrust springs become effective at time=$t_{1b}$ following which the door speed increases to a value $V_4$ until at point B the door reaches its position of closure at time $t=t_{2b}$.

However, if the thrust springs are rendered inoperative by appropriate adjustment of the plate 12, when the damping is set at minimum the door continues to close at velocity $V_1$ as indicated by the broken line M' until at point A' it reaches its position of closure at time $t=t_{1c}$ whereas when the damping is set at maximum the door continues at velocity $V_3$ as indicated by broken line N' until at point B' it reaches its position of closure at time=$t_{2c}$.

The shaded area bounded by points A, A', B and B' represents the envelope within which the closure time can be varied by the combined adjustments available by means of the adjustment plate 12 and the adjustable throttle incorporated in the damper assembly 50.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A door closer comprising:

an anchor member for mounting on a door frame, an actuator assembly for mounting within the thickness of a door which is hinged for movement between open and closed positions relative to said door frame, an operating member coupled by an articulated link to said anchor member and wherein said operating member is mounted in said actuator assembly and capable of a range of movement between a retracted position in which said anchor member is held immediately adjacent to said actuator assembly and an extended position in which said anchor member is held in spaced relation to said actuator assembly, a resilient driving means arranged to exert a driving force on said operating member in a manner such as to drive said operating member at a rate of movement towards said retracted position and thereby draw said anchor member and said actuator assembly together such that, when installed, the door closer acts to draw the door into the closed position relative to the door frame, a damper connected to said operating member, wherein the rate of movement of the operating member can be controlled in at least a direction towards said retracted position, said damper comprising a cylinder containing hydraulic fluid, said hydraulic fluid having a rate of flow, a piston rod carrying a piston which divides the cylinder into two chambers, and flow-restricting means to limit the rate of flow of hydraulic fluid from one of said chambers to the other at least in one direction of fluid flow in response to movement of said operating member towards said retracted position, a resilient thrust means arranged to exert an increased driving force on said operating member, a control means whereby said resilient thrust means applies said increased driving force to said operating member over a defined part of said range of movement as said operating member approaches said retracted position, wherein the defined part corresponds to movement of the door over a final part of its movement into the closed position and beginning at a point in the range of movement, and an adjustment member operatively connected with said control means to vary the point in the range of movement of said operating member at which said resilient thrust means applies said increased driving force, wherein the control means comprises a cam mechanism having a cam surface and a cam follower operatively associated with said thrust means, wherein movement of said cam follower along said cam surface causes a deformation of said thrust means, and wherein said cam surface comprises part of a slot provided in a control sleeve, the cam follower being moveable along a slot provided in a control member, the control member being slidably received within said control sleeve, movement of said operating member between said retracted and extended positions effecting movement of said control member within said control sleeve.

2. The door closer according to claim 1 wherein the slot in the control sleeve comprises a first part extending generally parallel to a longitudinal axis thereof and a second part extending obliquely away from said first part.

3. The door closer according to claim 2 wherein the second part extends away from said first part at an angle of about 45°.

4. The door closer according to claim 1, wherein the control sleeve and control member are generally cylindrical.

5. The door closer according to claim 1 wherein two similarly configured slots are provided in opposing surfaces of the control sleeve.

6. The door closer according to claim 5 wherein the cam follower engages both the slots.

7. The door closer according to claim 5 wherein the second parts of the slots lie on different sides of a plane containing the first parts, such that movement of the cam follower therealong causes the cam follower to undergo angular movement about said longitudinal axis.

8. The door closer according to claim 7 wherein the cam follower is associated with said thrust means such that said angular movement of said cam follower deforms said thrust means in both a compressive and a torsional manner.

9. The door closer according to claim 1 wherein an end of the resilient thrust means is attached to or integral with a retaining member slidably received within said control member.

10. The door closer according to claim 9 wherein the retaining member is received within the control member in a manner capable of undergoing angular movement about said longitudinal axis, angular movement of said cam follower effecting angular movement of said retaining member.

11. The door closer according to claim 1 wherein the control sleeve and control member are restrained against angular movement relative to each other, about said longitudinal axes.

12. The door closer according to claim 1 wherein the control member is attached to or integral with a cross-head operatively associated with said operating member in such a manner that angular movement relative thereto is resisted.

13. The door closer according to claim 2 wherein the slot in the control member is approximately the same length as the second part of the slot in the control sleeve.

14. The door closer according to claim 2 wherein the slot in the control member extends away from said longitudinal axis at an angle approximately equal to the angle at which said second part of the slot extends away from said first part.

15. The door closer according to claim 1 wherein two similarly configured slots are provided in opposing surfaces of the control member.

16. The door closer according to claim 1 wherein said thrust means comprises one or more spring elements having a higher rate than said resilient driving means.

17. The door closer according to claim 1 wherein said thrust means includes one or more coiled compression springs.

18. The door closer according to any one of claims 12 to 17 wherein the thrust means is attached to or integral with the retaining member and cross-head.

19. A door closer comprising:

an anchor member for mounting on a door frame, an actuator assembly for mounting within the thickness of a door which is hinged for movement between open and closed positions relative to said door frame, an operating member coupled by an articulated link to said anchor member and wherein said operating member is mounted in said actuator assembly and capable of a range of movement between a retracted position in which said anchor member is held immediately adjacent to said actuator assembly and an extended position in which said anchor member is held in spaced relation to said actuator assembly, a resilient driving means arranged to exert a driving force on said operating member in a manner such as to drive said operating member at a rate of movement towards said retracted position and thereby draw said anchor member and said actuator assembly together such that, when installed, the door closer acts to draw the door into the closed position relative to the door frame, a damper connected to said operating member, wherein the rate of movement of the operating member can be controlled in at least a direction towards said retracted position, said damper comprising a cylinder containing hydraulic fluid, said hydraulic fluid having a rate of flow, a piston rod carrying a piston which divides the cylinder into two chambers, and flow-restricting means to limit the rate of flow of hydraulic fluid from one of said chambers to the other at least in one direction of fluid flow in response to movement of said operating member towards said retracted position, a resilient thrust means arranged to exert an increased driving force on said operating member, a control means whereby said resilient thrust means applies said increased driving force to said operating member over a defined part of said range of movement as said operating member approaches said retracted position, wherein the defined part corresponds to movement of the door over a final part of its movement into the closed position and beginning at a point in the range of movement, and an adjustment member operatively connected with said control means to vary the point in the range of movement of said operating member at which said resilient thrust means applies said increased driving force, wherein the control means comprises a cam mechanism having a cam surface and a cam follower operatively associated with said thrust means, wherein movement of said cam follower along said cam surface causes a deformation of said thrust means, and wherein the cam follower comprises a roller rotatably mounted about a retaining pin.

* * * * *